US008627975B1

(12) United States Patent
Whitbeck et al.

(10) Patent No.: US 8,627,975 B1
(45) Date of Patent: Jan. 14, 2014

(54) CONTENT-SAVING SYSTEMS FOR SEALING OPENED PRODUCT TUBES AND PREVENTING PRODUCT HARDENING

(76) Inventors: Gordon Whitbeck, Greenbank, WA (US); Helen Whitbeck, Greenbank, WA (US)

( * ) Notice: Subject to any disclaimer, the term of this patent is extended or adjusted under 35 U.S.C. 154(b) by 0 days.

(21) Appl. No.: 13/603,771

(22) Filed: Sep. 5, 2012

(51) Int. Cl.
*B65D 51/00* (2006.01)
*B65D 51/18* (2006.01)
*B65D 51/20* (2006.01)
*B65D 25/28* (2006.01)

(52) U.S. Cl.
USPC ..... 220/254.1; 220/254.8; 220/258.1; 220/258.3; 220/258.4; 222/81

(58) Field of Classification Search
USPC ..... 220/212, 212.5, 254.1, 254.8, 254.9, 220/256.1, 258.1, 258.3, 258.4, 260, 265, 220/267, 277, 694; 222/80, 81, 83, 91; 7/100, 157
See application file for complete search history.

(56) References Cited

U.S. PATENT DOCUMENTS

| | | | | |
|---|---|---|---|---|
| 3,241,721 | A * | 3/1966 | Freeman | 222/93 |
| 3,506,157 | A | 4/1970 | Dukess | |
| 5,154,327 | A | 10/1992 | Long | |
| 5,295,601 | A | 3/1994 | Bostelman | |
| D360,828 | S | 8/1995 | Ball | |
| 6,375,051 | B1 | 4/2002 | Iverson | |
| 6,409,047 | B1 * | 6/2002 | Tanaka | 222/99 |
| 6,516,972 | B1 * | 2/2003 | Knestout | 222/151 |
| 7,490,629 | B2 * | 2/2009 | Williams et al. | 138/89 |
| 7,922,040 | B2 * | 4/2011 | Pierson | 222/151 |
| 8,342,351 | B2 * | 1/2013 | Hobbs, Sr. | 220/212.5 |
| 2005/0236441 | A1 * | 10/2005 | Martin | 222/546 |
| 2007/0215641 | A1 | 9/2007 | Fishman et al. | |

* cited by examiner

*Primary Examiner* — Anthony Stashick
*Assistant Examiner* — Madison L Poos

(57) ABSTRACT

A content-saving system featuring a plunger series, a cap series, and a winder series. After a hand-squeeze type tube or a cartridge gun type tube is opened for use, the caps are used to prevent hardening of contents during storage. The winder aids in forcing the contents out of the hand-squeeze tube. If the product contents harden to prevent use, the plunger is used to clear the obstruction in the end of either type tube. Additional caps of both sizes and winders may be provided with the plunger assembly in kit form or sold separately when the consumer needs additional units for storage surplus.

7 Claims, 6 Drawing Sheets

SYSTEM

SYSTEM

200 SERIES

CONTENT-SAVING SYSTEMS FOR SEALING OPENED PRODUCT TUBES AND PREVENTING PRODUCT HARDENING

BACKGROUND OF THE INVENTION

After consumers or contractors open a squeeze tube or cartridge for application of a product (e.g., sealant, glue, etc.), the cap is replaced (or in some cases no cap is provided). If not used soon, the contents will set near the exit hole and the remainder may be lost, necessitating re-purchase. The present invention features content-saving systems (e.g., Series 100 plunger, Series 200 caps, Series 300 winder) for tubes and cartridges. The caps of the present invention help prevent localized hardening of a product at the opening. The tubes and cartridges can be pierced (when needed) by the 100 Series Plunger, with assist of the 300 Series Winder, to obtain the remainder of the contents (in the hand squeeze version per FIG. 7). The four system components may be provided in a kit with extra 200 Series caps and 300 Series winders, provided for storage use after piercing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 6 shows a sample of a product (cartridge type product 601) that the Series 100 and Series 200 systems are adapted to pierce, open, and seal.

DESCRIPTION OF PREFERRED EMBODIMENTS

Figure 5:
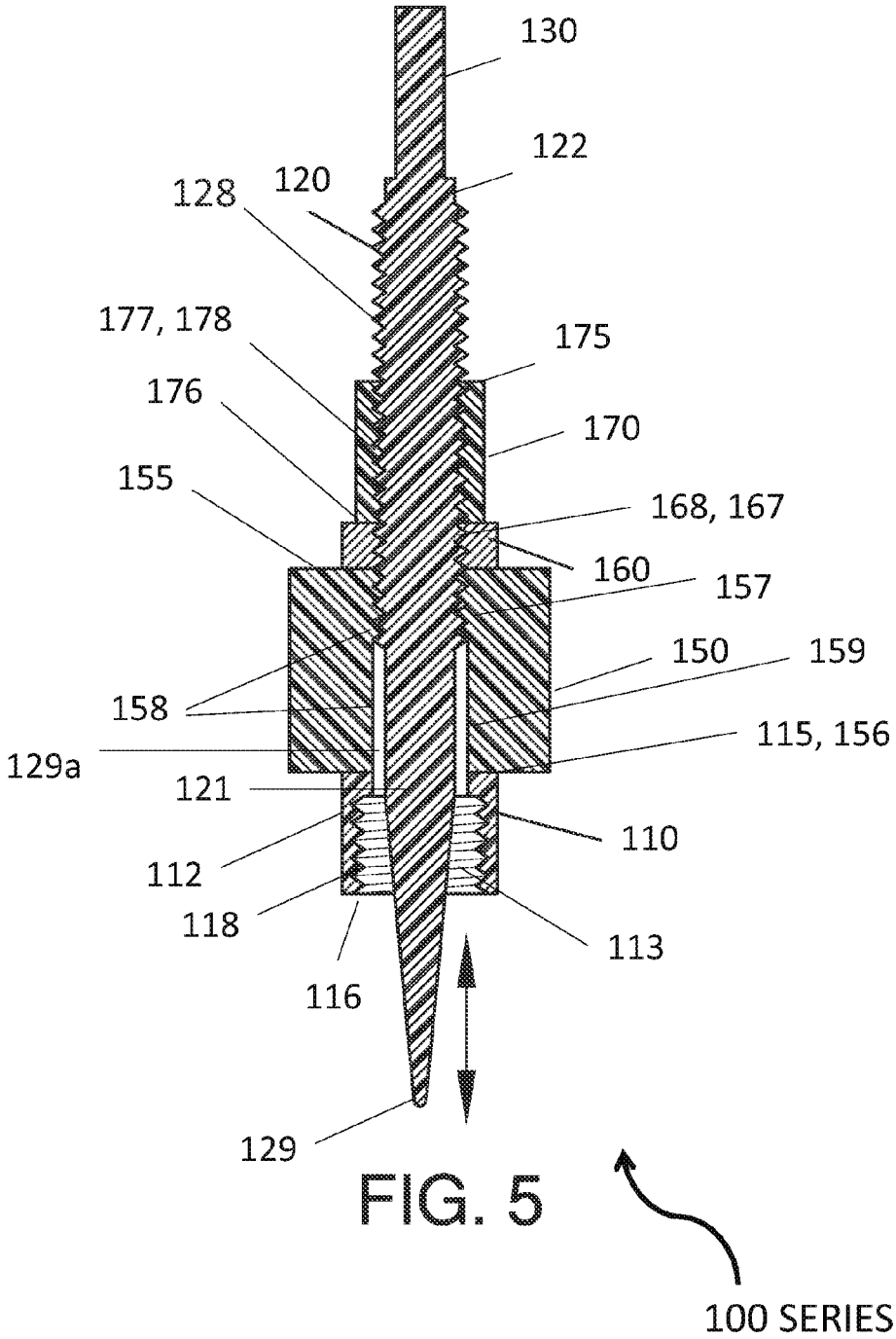
FIG. 5 is a cross sectional view of a 100 Series plunger assembly.

Referring now to FIGS. 1, 2, 3, and 5, the present invention features content-saving systems comprising Series 100 (e.g., the "Plunger"), for piercing previously opened product tubes with internal hardening near the opening. In some embodiments, as shown in the aforementioned Figures, the Series 100 Plunger comprises a base (110) having a sidewall (112), a top surface (115), a bottom surface (116) (e.g., an open bottom with a bottom edge), and an inner cavity (113) formed by the sidewall (112). Threads (118) line at least a portion of the inner surface of the sidewall (112) as shown in FIG. 5. In some embodiments, the inner cavity (113) may also be of a self-tapping material produced as a result of manufacturing economics.

The Series 100, Series 200, and Series 300 systems may be manufactured as single-piece systems or multi-piece systems, e.g., the Series 100, Series 200, and Series 300 systems may be cast by injection molding as a one-piece components, two-piece components, three-piece components, etc. The present invention is not limited to the aforementioned configurations of manufacturing. The descriptions herein, e.g., those describing various ends and surfaces, are for reference and, depending on the construction of the systems of the present invention, may not necessarily be visible on the finished manufactured products.

Figure 1:
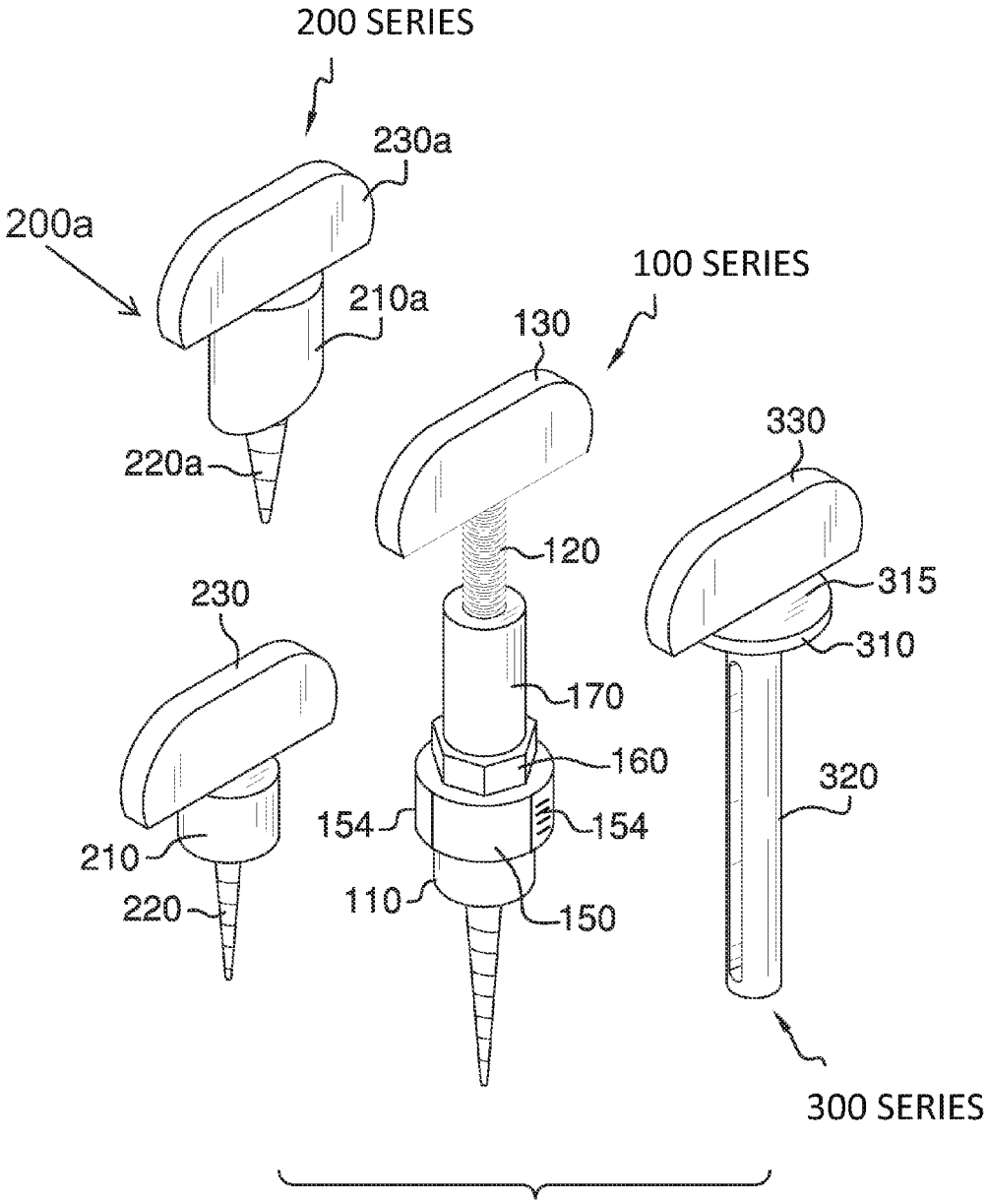
FIG. 1 is a perspective view of the Plunger ("100 Series"), Winder ("300 Series"), and two Storage Caps ("200 Series") to suit bead size.
Figure 2:
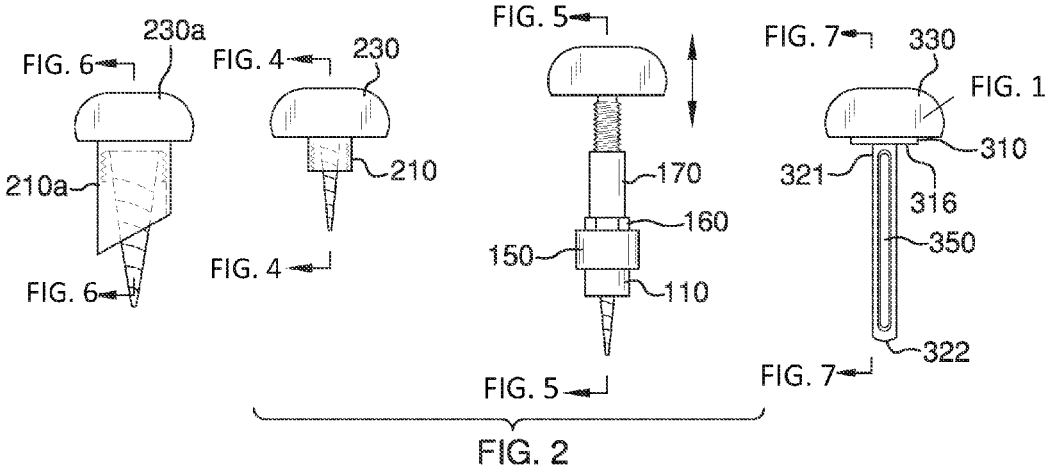
FIG. 2 is a side view of components in FIG. 1.
Figure 3:
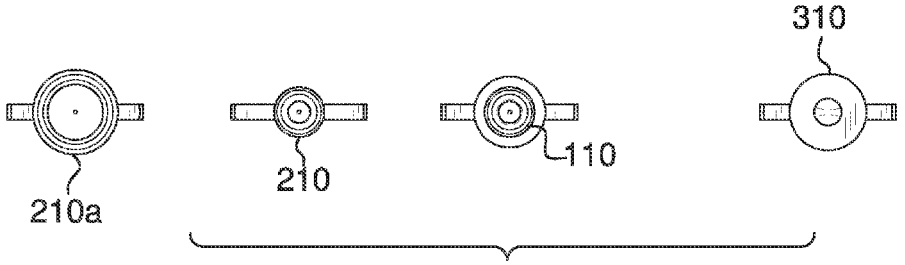
FIG. 3 is a bottom view of FIG. 2 components.
Figure 4:
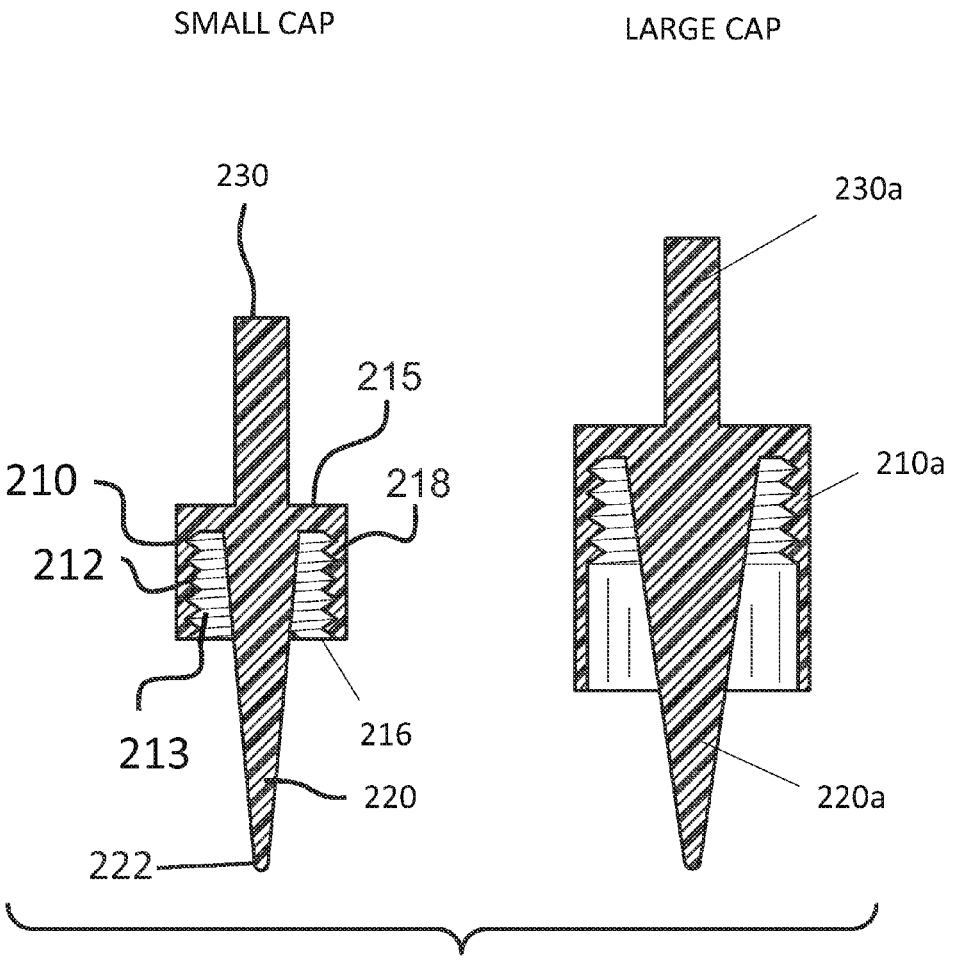
FIG. 4 shows cross sectional views of the smaller cap (230) and the larger cap (230*a*) of FIG. 2.

A first support base (150) is disposed atop the base (110). For example, the first support base (150) has a top surface (155), a bottom surface (156) that contacts the top surface (115) of the base (110), and an inner channel (158). The inner channel (158) extends from the top surface (155) to the bottom surface (156). Threads (157) line a portion of the inner channel (158), e.g., a portion extending from the top surface (155) downwardly a distance downwardly toward the bottom surface (156). As shown in FIG. 5, at least a portion of the inner channel (158) is unthreaded (159) from the bottom surface (156) upwardly. In some embodiments, the first support base (150) comprises two flats (154) as shown in FIG. 1. The flats (154) may help provide for a better grip for the user to hand turn the first support base (150) prior to using a tool to turn the hex (160) above the first support base (150), if required.

The system (100) further comprises a hex (160) disposed atop the first support base (150). The hex (160) has a hexagonal cross section as viewed from above. The hex (160) has an inner channel (168) that is aligned with the inner channel (158) of the first support base (150). The inner channel (168) of the hex (160) is lined with threads (167).

The system (100) further comprises a second support base (170) disposed atop the hex (160). For example, the second support base (170) has a top surface (175), a bottom surface (176) that contacts the hex (160), and an inner channel (178) extending from the top surface (175) to the bottom surface (176). The inner channel (178) is aligned with the inner channel (168) of the hex (160). Threads (177) line the inner channel (178) from the top surface (175) to the bottom surface (176) as shown in FIG. 5.

The system (100) further comprises a threaded plunger (120) extending downwardly through each the inner channel (178) of the second support base (170), the inner channel (168) of the hex (160), the inner channel (158) of the first support base (150), and the inner cavity (113) of the base (110). The threaded plunger (120) has a first end (121) that extends past the bottom edge (116) of the base (110) and a second end (122) that extends past the top surface (175) of the second support base (170). A cone-shaped end (129) is disposed on the first end (121) of the threaded plunger (120). In some embodiments, the cone-shaped end (129) is serrated into spiral form to cut/penetrate contents of hardened products. Threads (128) line at least a portion of the threaded plunger (120) from the second end (122) to near the first end (121), and at least a portion of the threaded plunger (120) is unthreaded (129*a*) from the first end (121) upwardly. The threaded plunger (120) can move upwardly and downwardly with respect to the base (110), first support base (150), hex (160), and second support base (170).

The Series 100 Plunger Assembly further comprises a handle (130) attached to the second end (122) of the threaded plunger (120). The handle has a flat front surface, a flat back surface, a curved top surface, and a flat bottom surface.

The threaded plunger (120) is adapted to be inserted in a stem of a tube (e.g., a cartridge-type product (601) or a hand squeeze tube product (701)) for piercing purposes if hardening occurs after initial opening.

In some embodiments, the unthreaded portion (159) of the first support base (150) allows passage of the unthreaded portion (129*a*) and cone (129) of the threaded plunger (120).

In some embodiments, the bottom edge (116) of the base (110) is beveled. In some embodiments, the bottom edge (116) of the base (110) is flat.

Figure 6:
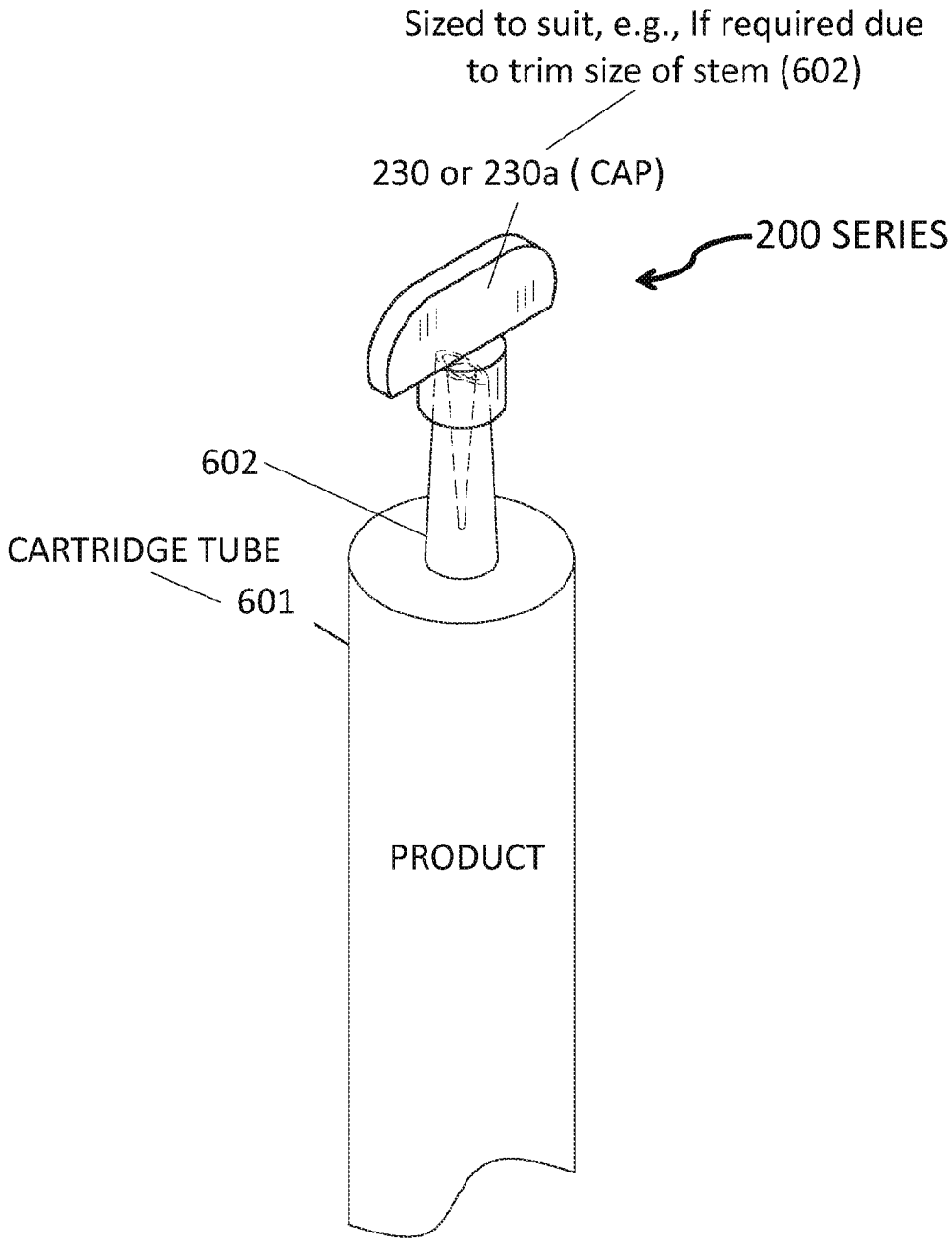
FIG. 6 is an in-use view of a content-saving cap of the present invention.

Referring to FIGS. 1-4 and 6-7, the present invention also features Series 200 storage caps. The Series 200 systems may be constructed in a variety of sizes. For example, two sizes of bases are shown, a first base (210) and a second base (210*a*). Two sizes of plungers are shown, a first plunger (220) and a second plunger (220*a*). The trim length of the stem (602) (as shown in FIG. 6) will determine which size Series 200 storage cap to utilize.

In some embodiments, the Series 200 storage cap comprises a base (210, 210*a*) having a sidewall (212), a top surface (215), an open bottom surface with a bottom edge (216), and an inner cavity (213) formed by the sidewall (212). Threads (218) line an inner surface of the side-wall (212) near the top surface (215). A plunger (220, 220*a*) extends downwardly from the top surface (215) of the base (210) through the inner cavity (213) of the base (210) and past the bottom edge (216) of the base (210). The plunger (220) is cone-shaped and the pointed end (222) of the plunger (220) faces opposite the base (210) and extends past the bottom edge (116) of the base (210). A handle (230) is disposed on the top surface (215) of the base (210). In some embodiments, the Series 200 storage caps will be injection molded of a poly material in one piece.

Figure 7:
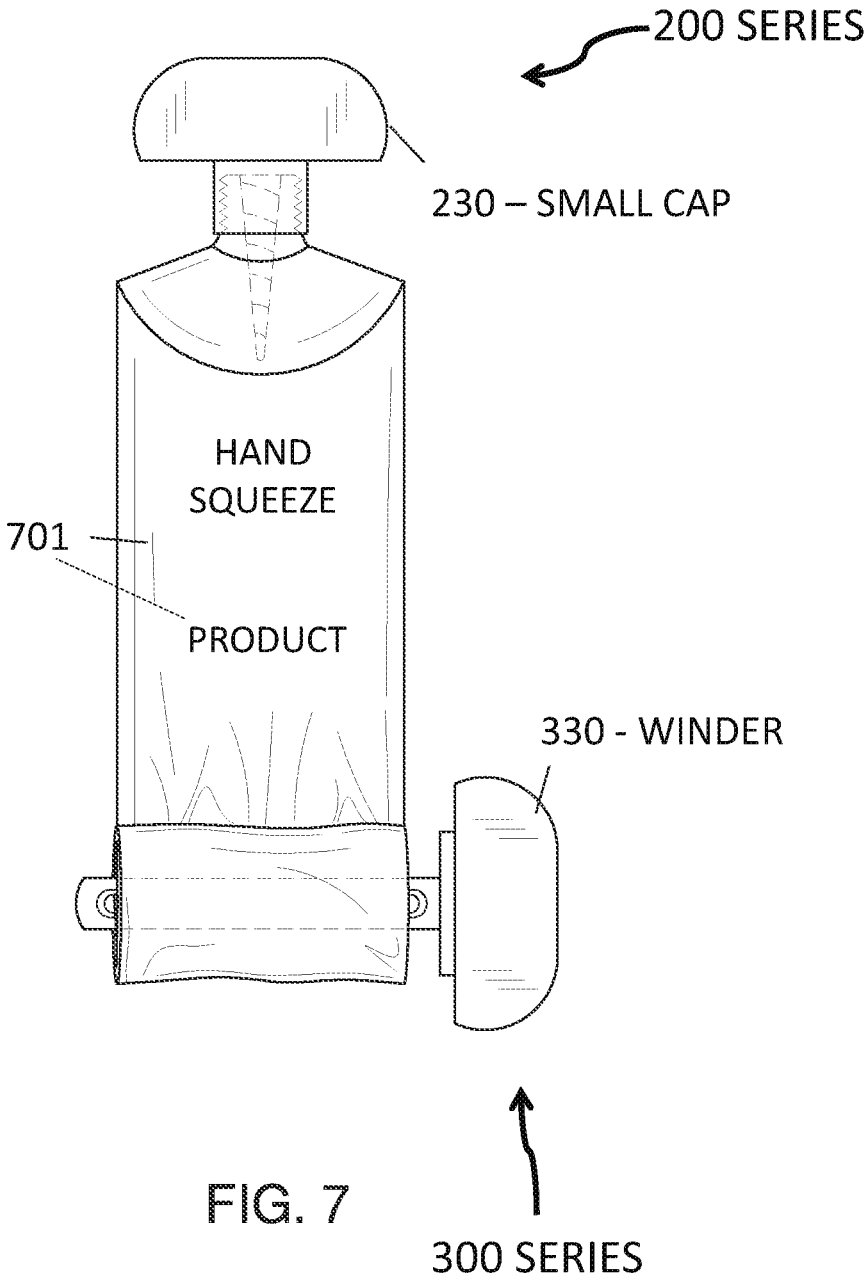
FIG. 7 is an in-use view of Cap and Winder and a hand squeeze product (701) that the Series 200 system is adapted to pierce and seal.

In some embodiments, only the smallest of the caps (200) base 210)) will be used to seal and store the hand squeeze product (701) (see FIG. 7). In some embodiments, both sizes may be used with the cartridge type product (601) as shown in FIG. 6. The sizes of the stem may determine the size of the cap (200) used. It is not generally intended for the larger cap (200*a*) to be used on the hand squeeze product (701). In some embodiments, where a large bead is desired, the stem is trimmed back, e.g., at an angle, and the larger cap (200) is necessary to seal the stem of the tube (with the larger plunger (220*a*) and handle (230*a*)).

In some embodiments, the plunger (220) is adapted to be inserted (as shown in FIG. 6) into a product's hollow stem (602), but not into the tube (601). If the product stem (602) is trimmed short to provide a larger bead, then the cap (200) with the larger plunger (220*a*) may be utilized and may protrude into the product tube (601). Generally, the product is sealed by the contact of the plunger (220) against the inner wall of the stem (602), not necessarily by the contact of the base (210) and the end of the stem (602).

As shown in FIG. 6, the plunger (220) is inserted into the stem (602) such that the outer surface of the plunger (220) and the inner surface of the stem (602) together form a seal. As shown in FIG. 7, the 200 Series cap (200, 230) (small cap) is screwed on the hand squeeze product tube (701) to replace original product cap in order to seal with the small cone also entering contents.

In some embodiments, the 200 Series caps (200) are constructed using a one-piece mold. In some embodiments, the threads (218) are formed from self-threading material wherein when the system (200) is screwed onto a product tube (701) threads are created. In some embodiments, the base (210) is at least partially filed with Poly type material.

The present invention also features Series 300 Winders. In some embodiments, the winder (300) comprises a base (310) having a top surface (315) and a bottom surface (316). A stem (320) extends downwardly from the bottom surface (316) of the base (310). The stem (320) has a first end (321) that contacts the base (310) and a second end (322). A slot (350) is disposed in the stem (320) extending from near the first end (321) to near the second end (322). The slot (350) is adapted to accept an end of a tube (701). A handle (330) is disposed on the top surface (315) of the base (310). In some embodiments, the handle (330) has a flat front surface, a flat back surface, a curved top surface, and a flat bottom surface. In some embodiments, the stem (320) is cylindrical. In some embodiments, the stem (320) is flat.

The present invention also features a kit comprising one or more of the Series 100 plunger, Series 200 caps, and/or Series 300 winder. For example, in some embodiments, the present invention features a kit comprising one Series 100 Plunger assembly, three each of the two differently sized Series 200 caps, and six of the Series 300 Winders. The extras may be left on the previously opened tubes for storage purposes. In some embodiments, the kit comprises at least one Series 100 Plunger, at least one Series 200 caps, and at least one Series 300 Winder.

As used herein, the term "about" refers to plus or minus 10% of the referenced number, e.g., referenced dimension.

The disclosures of the following U.S. patents are incorporated in their entirety by reference herein: U.S. Pat. No. 5,295,601; U.S. Pat. No. 6,375,051; U.S. Pat. No. 5,154,327; U.S. Pat. Application No. 2007/0215641; U.S. Pat. No. 3,506,157; U.S. Design Pat. No. D360.828.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features haying the corresponding reference numbers in the drawings.

What is claimed:

1. A content-saving plunger system (100) for piercing a cartridge-type product tube (601) or a hand-squeeze product tube (701) if hardening occurs after initial opening, said plunger system (100) comprising:

(a) a base (110) having a sidewall (112), a top surface (115), an open bottom surface with a bottom edge (116), an inner cavity (113) formed by the sidewall (112), wherein threads (118) are disposed on at least a portion of an inner surface of the sidewall (112);

(b) a first support base (150) disposed atop the base (110), the first support base (150) has a top surface (155), a bottom surface (156) that contacts the top surface (115) of the base (110), and an inner channel (158) extending from the top surface (155) to the bottom surface (156), wherein threads (157) are disposed on a portion of the inner channel (158) extending from the top surface (155) a distance downwardly through the inner channel (158), at least a portion of the inner channel (158) is unthreaded (159) from the bottom surface (156) upwardly;

(c) a hex (160) disposed atop the first support base (150), the hex (160) has a hexagonal cross section as viewed from above, the hex (160) has an inner channel (168) that is aligned with the inner channel (158) of the first support base (150), the inner channel (168) is lined with threads (167);

(d) a second support base (170) disposed atop the hex (160), the second support base (170) has a top surface (175), a bottom surface (176) that contacts the hex (160), and an inner channel (178) extending from the top surface (175) to the bottom surface (176), the inner channel (178) is aligned with the inner channel (168) of the hex (160), wherein threads (177) line the inner channel (178) from the top surface (175) to the bottom surface (176);

(e) a threaded plunger (120) extending downwardly through each the inner channel (178) of the second support base (170), the inner channel (168) of the hex (160), the inner channel (158) of the first support base (150), and the inner cavity (113) of the base (110), the threaded plunger (120) has a first end (121) that extends past the bottom edge (116) of the base (110) and a second end (122) that extends past the top surface (175) of the second support base (170), wherein a cone-shaped end (129) is disposed on the first end (121) of the threaded plunger (120), wherein threads (128) are disposed along at least a portion of the threaded plunger (120) from the second end (122) to near the first end (121) and at least a portion of the threaded plunger (120) is unthreaded (129*a*) from the first end (121) upwardly, the threaded plunger (120) can move upwardly and downwardly with respect to the base (110), first support base (150), hex (160), and second support base (170); and (f) a handle (130) disposed on the second end (122) of the threaded plunger (120); wherein the threaded plunger (120) is adapted to be inserted in a stem (602) of a cartridge-type product tube (601) or a hand-squeeze product tube (701).

2. The system (100) of claim 1, wherein the inner cavity (113) of the base (110) is filled with self-tapping material.

3. The system (100) of claim 1, wherein the bottom edge (116) of the base (110) is beveled.

4. The system (100) of claim 1, wherein the bottom edge (116) of the base (110) is flat.

5. A kit comprising:

(i) at least one plunger system (100) comprising (a) a base (110) having a side wall (112), a top surface (115), an open bottom surface with a bottom edge (116), an inner cavity (113) formed by the side wall (112), wherein threads (118) are disposed on an inner surface of the side wall (112) of the inner cavity (113); (b) a first support base (150) disposed atop the base (110), the first support base (150) has a top surface (155), a bottom surface (156) that contacts the top surface (115) of the base (110), and an inner channel (158) extending from the top surface (155) to the bottom surface (156), wherein threads (157) are disposed on a portion of the inner channel (158) extending from the top surface (155) a distance downwardly through the inner channel (158), at least a portion of the inner channel (158) is unthreaded (159) from the bottom surface (156) upwardly, at least two flats (154) are disposed on the first support base (150); (c) a hex (160) disposed atop the first support base (150), the hex (160) has a hexagonal cross section as viewed from above, the hex (160) has an inner channel (168) that is aligned with the inner channel (158) of the first support base (150), the inner channel (168) is lined with threads (167); (d) a second support base (170) disposed atop the hex (160), the second support base (170) has a top surface (175), a bottom surface (176) that contacts the hex (160), and an inner channel (178) extending from the top surface (175) to the bottom surface (176), the inner channel (178) is aligned with the inner channel (168) of the hex (160), wherein threads (177) line the inner channel (178) from the top surface (175) to the bottom surface (176); (e) a threaded plunger (120) extending downwardly through each the inner channel (178) of the second support base (170), the inner channel (168) of the hex (160), the inner channel (158) of the first support base (150), and the inner cavity (113) of the base (110), the threaded plunger (120) has a first end (121) that extends past the bottom edge (116) of the base (110) and a second end (122) that extends past the top surface (175) of the second support base (170), wherein a cone-shaped end (129) is disposed on the first end (121) of the threaded plunger (120), wherein threads (128) are disposed along at least a portion of the threaded plunger (120) from the second end (122) to near the first end (121) and at least a portion of the threaded plunger (120) is unthreaded (129*a*) from the first end (121) upwardly, the threaded plunger (120) can move upwardly and downwardly with respect to the base (110), first support base (150), hex (160), and second support base (170); and (f) a handle (130) disposed on the second end (122) of the threaded plunger (120);

(ii) at least one cap system (200) comprising (a) a base (210) having a side wall (212), a top surface (215), an open bottom surface with a bottom edge (216), an inner cavity (213) formed by the side wall (212), wherein threads (218) are disposed on an inner surface of the side wall (212) near the top surface (215); and (b) a plunger (220) extending downwardly from the bottom surface (216) of the base (210) through the inner cavity (213) of the base (210), the plunger is cone-shaped and extends past the bottom edge (216) of the base (210); and (c) a handle (230) disposed on the top surface (235) of the base (210); and (iii) at least one winder system (300) comprising: (a) a base (310) having a top surface (315) and a bottom surface (316); (b) a stem (320) extending downwardly from the bottom surface (316) of the base (310), the stem (320) has a first end (321) that contacts the base (310) and a second end (322), wherein a slot (350) is disposed in the stem (320) extending from near the first end (321) to near the second end (322), the slot (350) is adapted to accept an end of a tube (701); and (c) a handle (360) disposed on the top surface (315) of the base (310).

6. The kit of claim 5, wherein the stem (320) is cylindrical.

7. The kit of claim 5, wherein the stem (320) is flat.

* * * * *